US009331391B2

(12) United States Patent
Chien et al.

(10) Patent No.: US 9,331,391 B2
(45) Date of Patent: May 3, 2016

(54) MOBILE DEVICE

(75) Inventors: Chih-Ling Chien, Taoyuan County (TW); Chien-Hsin Huang, Taoyuan County (TW); Hsiao-Wei Wu, Taoyuan County (TW); Wen-Hsiung Shih, Taoyuan County (TW)

(73) Assignee: HTC Corporation, Taoyuan (TW)

( * ) Notice: Subject to any disclaimer, the term of this patent is extended or adjusted under 35 U.S.C. 154(b) by 171 days.

(21) Appl. No.: 13/396,122

(22) Filed: Feb. 14, 2012

(65) Prior Publication Data

US 2013/0207855 A1 Aug. 15, 2013

(51) Int. Cl.

| | |
|---|---|
| ***H01Q 1/24*** | (2006.01) |
| ***H01Q 1/38*** | (2006.01) |
| ***H01Q 1/06*** | (2006.01) |
| ***H01Q 13/10*** | (2006.01) |
| ***H01Q 9/42*** | (2006.01) |
| ***H01Q 21/30*** | (2006.01) |

(52) U.S. Cl.

CPC ..... *H01Q 9/42* (2013.01); *H01Q 13/10* (2013.01); *H01Q 21/30* (2013.01); *H01Q 1/243* (2013.01)

(58) Field of Classification Search

CPC ..... H01Q 21/30; H01Q 5/0058; H01Q 5/357; H01Q 5/371; H01Q 1/243

USPC ..... 343/700 MS, 721

See application file for complete search history.

(56) References Cited

U.S. PATENT DOCUMENTS

| | | | | |
|---|---|---|---|---|
| 6,781,546 | B2 | 8/2004 | Wang et al. | |
| 7,546,114 | B1 | 6/2009 | Glaze, Jr. | |
| 2004/0017319 | A1* | 1/2004 | Wang et al. | 343/702 |
| 2007/0241971 | A1* | 10/2007 | Tsujimura et al. | 343/702 |
| 2008/0074329 | A1* | 3/2008 | Caballero et al. | 343/702 |
| 2008/0278265 | A1* | 11/2008 | Koizumi et al. | 333/219 |
| 2008/0316117 | A1 | 12/2008 | Hill et al. | |
| 2009/0153411 | A1* | 6/2009 | Chiang et al. | 343/702 |
| 2009/0179803 | A1* | 7/2009 | Tsai et al. | 343/700 MS |
| 2010/0060525 | A1* | 3/2010 | Yang et al. | 343/700 MS |
| 2010/0060528 | A1* | 3/2010 | Chiu et al. | 343/700 MS |
| 2010/0188301 | A1* | 7/2010 | Kishimoto et al. | 343/721 |
| 2011/0133995 | A1 | 6/2011 | Pascolini et al. | |
| 2011/0136447 | A1 | 6/2011 | Pascolini et al. | |
| 2011/0175794 | A1 | 7/2011 | Tai et al. | |
| 2011/0237309 | A1* | 9/2011 | Shoji et al. | 455/575.1 |
| 2011/0241949 | A1 | 10/2011 | Nickel et al. | |
| 2011/0300907 | A1* | 12/2011 | Hill et al. | 455/566 |
| 2012/0050114 | A1* | 3/2012 | Li et al. | 343/702 |

FOREIGN PATENT DOCUMENTS

| | | | |
|---|---|---|---|
| CN | 1260606 | A | 7/2000 |
| CN | 1828995 | A | 9/2006 |
| CN | 101743573 | A | 6/2010 |

(Continued)

*Primary Examiner* — Dameon E Levi

*Assistant Examiner* — Ricardo Magallanes

(74) *Attorney, Agent, or Firm* — Birch, Stewart, Kolasch & Birch, LLP

(57) ABSTRACT

A mobile device includes a substrate, a ground element, and a radiation branch. The ground element includes a ground branch, wherein an edge of the ground element has a notch extending into an interior of the ground element so as to form a slot region, and the ground branch partially surrounds the slot region. The radiation branch is substantially inside the slot region, and is coupled to the ground branch of the ground element. The ground branch and the radiation branch form an antenna structure.

17 Claims, 8 Drawing Sheets

(56) References Cited

FOREIGN PATENT DOCUMENTS

| | | | |
|---|---|---|---|
| CN | 102214854 | A | 10/2011 |
| CN | 102324619 | A | 1/2012 |
| EP | 2 584 647 | A2 | 4/2013 |
| EP | 2 629 368 | A1 | 8/2013 |
| TW | I 258 242 | B | 7/2006 |
| TW | I266451 | B | 11/2006 |

* cited by examiner

MOBILE DEVICE

BACKGROUND OF THE INVENTION

1. Field of the Invention

The subject application generally relates to a mobile device, and more particularly, relates to a mobile device for operation in multiple frequency bands.

2. Description of the Related Art

With the progress of mobile communication technology, portable electronic devices, for example, portable computers, mobile phones, multimedia players, and other hybrid functional portable electronic devices, have become more common. To satisfy the demand of users, portable electronic devices usually can perform wireless communication functions. Some functions cover a large wireless communication area, for example, mobile phones using 2G, 3G, GPS and LTE (Long Term Evolution) systems and using frequency bands of 700 MHz, 850 MHz, 900 MHz, 1800 MHz, 1575 MHz, 1900 MHz, 2100 MHz, 2300 MHz, and 2500 MHz. Some functions cover a small wireless communication area, for example, mobile phones using Wi-Fi, Bluetooth, and WiMAX (Worldwide Interoperability for Microwave Access) systems and using frequency bands of 2.4 GHz, 3.5 GHz, 5.2 GHz, and 5.8 GHz.

Traditionally, a metal element with a fixed size is used as a main body of an antenna. The metal element is half wavelength or one-fourth wavelength in length, wherein the wavelength corresponds to the desired frequency band. For durability and aesthetics, a mobile device has at least a part of the housing (e.g., the front, the back or the frame/bezel) that is made of metal. However, the metal housing has a bad impact on antenna radiation.

BRIEF SUMMARY OF THE INVENTION

In one exemplary embodiment, the subject application is directed to a mobile device, comprising: a substrate; a ground element, comprising a ground branch, wherein an edge of the ground element has a notch extending into an interior of the ground element to form a slot region, and the ground branch partially surrounds the slot region; and a radiating branch, disposed inside the slot region, and coupled to the ground branch of the ground element, wherein the ground branch and the radiating branch form an antenna structure.

BRIEF DESCRIPTION OF DRAWINGS

The subject application can be more fully understood by reading the subsequent detailed description and examples with references made to the accompanying drawings, wherein.

DETAILED DESCRIPTION OF THE INVENTION

Figure 1:
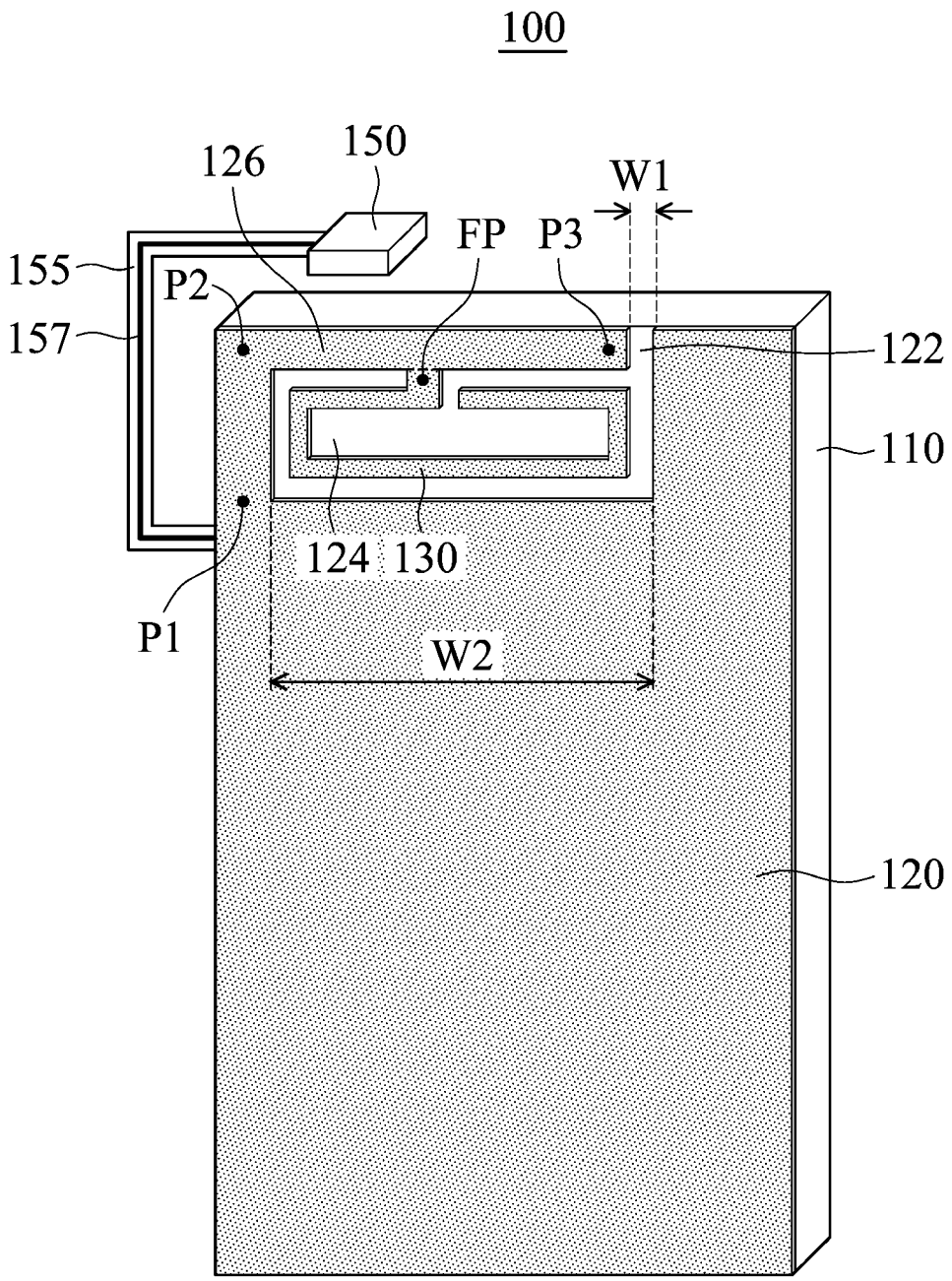
FIG. 1 is a diagram for illustrating a mobile device according to an embodiment of the invention.

FIG. 1 is a diagram for illustrating a mobile device 100 according to an embodiment of the invention. The mobile device 100 at least comprises a substrate 110, a ground element 120, a radiating branch 130, a processor, a display module, a touch-screen module, an input module, and other relative electronic components (not shown). The substrate 110 may be an FR4 substrate with a 4.3 dielectric constant. In an embodiment, the substrate 110 is approximately 0.8 mm in thickness. The ground element 120 and the radiating branch 130 are at least partially conductive. They may be made of metal, such as silver or copper, or may be coated on a carrier of the radiating branch 130 with conductive paint, such as LDS (Laser Direct Structuring). In an embodiment, the ground element 120 is a plane layer disposed on the substrate 110.

The ground element 120 comprises a ground branch 126. An edge of the ground element 120 has a notch 122 which extends into the interior of the ground element 120 so as to form a slot region 124. The slot region 124 substantially has a rectangular shape. With respect to the real structure, the edge of the ground element 120 is partially open. The length W2 of the slot region 124 is greater than the length W1 of the notch 122. The length W1 of the notch 122 is approximately from 0.3 mm to 2 mm. In a preferred embodiment, the length W1 of the notch 122 is approximately 0.6 mm. The ground branch 126 partially surrounds the slot region 124. The radiating branch 130 is disposed on the substrate 110 or a carrier thereof. The radiating branch 130 is substantially inside the slot region 124, and is further electrically coupled to the ground branch 126 of the ground element 120.

The ground branch 126 and the radiating branch 130 form an antenna structure together, wherein a feeding point FP of the antenna structure may be electrically coupled to a signal source, and each of the ground branch 126 and the radiating branch 130 is a part of the current path. In a preferred embodiment, the radiating branch 130 substantially has a C-shape, and the ground branch 126 of the ground element 120 substantially has an L-shape. The length of the radiating branch 130 is greater than the length of the ground branch 126. Note that the radiating branch 130 may be meander to form a variety of shapes, such as an L-shape or a W-shape. When an input signal is fed through the feeding point FB into the antenna structure, the radiating branch 130 is excited to form a low frequency band, and the ground branch 126 is excited to from at least a high frequency band. Therefore, the mobile device 100 can operate in multiple frequency bands.

In a preferred embodiment, the mobile device 100 further comprises a power button 150, an FPCB (Flexible Printed Circuit Board) 155, and a signal line 157. The power button 150 is disposed to be close to the ground branch 126 of the ground element 120. The signal line 157 is disposed on the FPCB 155, and is electrically coupled between the power button 150 and the substrate 110 so as to transmit a power signal. In other embodiments, the signal line 157 may be also electrically coupled to a volume key (not shown). Note that the signal line 157 and the FPCB 155 substantially extend along or around the ground branch 126 of the ground element 120. Since the signal line 157 and a resonant path of the antenna structure extend in the same direction, the antenna structure is not influenced much by the power button 150 and the signal line 157.

Figure 2:
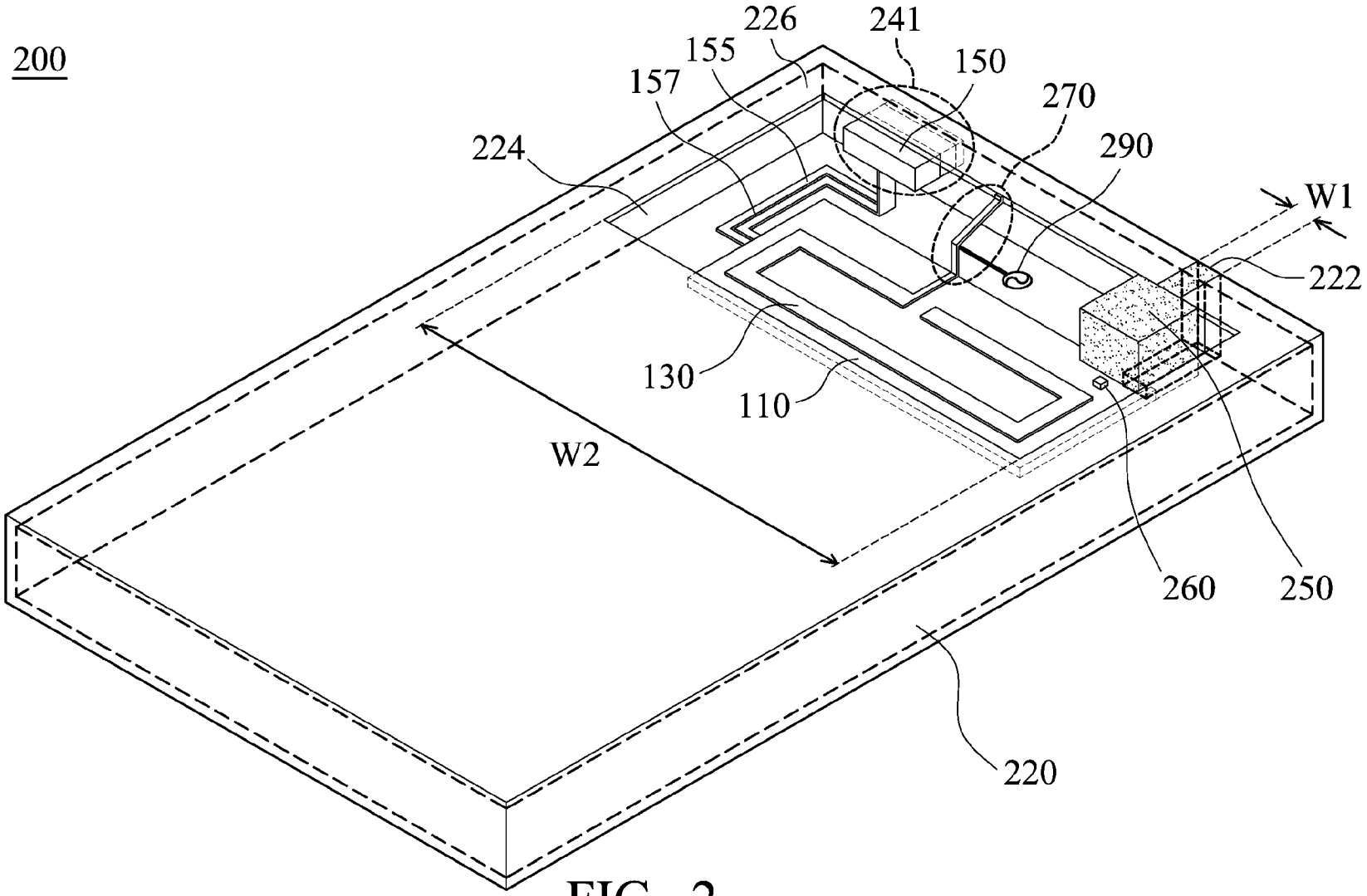
FIG. 2 is a diagram for illustrating a mobile device according to a preferred embodiment of the invention.

FIG. 2 is a diagram for illustrating a mobile device 200 according to a preferred embodiment of the invention. As shown in FIG. 2, the mobile device 200 at least comprises a substrate 110, a ground element 220, and a radiating branch 130. The mobile device 200 is similar to the mobile device 100 as shown in FIG. 1, and relatively similar components will not be described again hereafter. Note that in the embodiment, the ground element 220 is a conductive housing of the mobile device 200. The conductive housing has a hollow space in which the substrate 110, the radiating branch 130 and other relative components are accommodated/disposed. Note that the conductive housing may have different shapes (e.g., the conductive housing has openings with different sizes and shapes), and the openings can be formed in any part of the conductive housing. The ground element 220 and the radiating branch 130 are at least partially conductive, and are made of metal or coated on a carrier of the ground element 220 and the radiating branch 130 with conductive paint, such as LDS.

Similarly, the ground element 220 comprises a ground branch 226. An edge of the ground element 220 has a notch 222 which extends into the interior of the ground element 220 so as to form a slot region 224. The ground branch 226 partially surrounds the slot region 224. In some embodiments, the notch 222 of the ground element 220 is formed as follows: (1) from the front of the mobile device 100 to the side further to the back thereof; (2) from the side of the mobile device 100 to the back thereof; (3) from the front of the mobile device 100 to the side thereof; or (4) in one of the front, the side and the back of the mobile device 100. In a preferred embodiment, the length W1 of the notch 222 is approximately from 0.3 mm to 2 mm. The radiating branch 130 is disposed on the substrate 110 or a carrier thereof. The radiating branch 130 is substantially inside the slot region 224, and is further electrically coupled to the ground branch 226 of the ground element 220. The ground branch 226 and the radiating branch 130 form an antenna structure together, and each of the ground branch 226 and the radiating branch 130 is a part of the current path. The mobile device 200 may further comprise a parallel feeding element 270, wherein a signal source 290 is electrically coupled through the parallel feeding element 270 to the ground branch 226 and to the radiating branch 130, respectively. In the embodiment, since the conductive housing of the mobile device 200 is a part of the antenna structure, communication performance of the mobile device is not influenced much by the conductive housing. In addition, the ground element 220 is implemented by the conductive housing so as to save from taking up too much design space for the antennas.

In an embodiment, the mobile device 200 further comprises a power button 150, an FPCB (Flexible Printed Circuit Board) 155, and a signal line 157. The ground element 220 may have a button hole 241 in which the power button 150 may be disposed. Similarly, the signal line 157 and the FPCB 155 substantially extend along the ground branch 226 of the ground element 220 (i.e., in the direction toward the notch 222) so as to avoid interference with the antenna structure.

In an embodiment, the mobile device 200 further comprises a transparent nonconductive structure 250 and an LED (Light Emitting Diode) 260. The transparent nonconductive structure 250 comprises at least an optical plane (not shown), and is partially embedded into the notch 222 of the ground element 220 so as to separate the ground element 220 from the open end of the ground branch 226. The LED 260 is disposed on the substrate 110 and generates light through the transparent nonconductive structure 250. In an embodiment, the light may blink in connection with the optical plane so as to have functions of indicating, reminding, and delivering signals. The LED 260 may be electrically coupled to a processor (not shown) of the mobile device 200, wherein the processor is configured to control the light condition of the LED 260.

Figure 3:
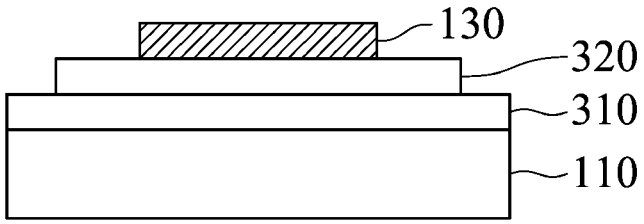
FIG. 3 is a diagram for illustrating a substrate and objects thereon according to an embodiment of the invention.

FIG. 3 is a diagram for illustrating the substrate 110 and objects thereon according to an embodiment of the invention. As shown in FIG. 3, the mobile device 200 further comprises a plastic carrier 310 and an antenna FPCB (Flexible Printed Circuit Board) 320. The plastic carrier 310 is supported by the substrate 110, and the antenna FPCB 320 is disposed on the plastic carrier 310. The plastic carrier 310 can support the antenna FPCB 320. In the embodiment, the radiating branch 130 is disposed on the antenna FPCB 320, and has a variable shape. In other embodiments, the radiating branch 130 is coated on the plastic carrier 310 or other components (e.g., PCB, Printed Circuit Board) with LDS technology.

Figure 4:
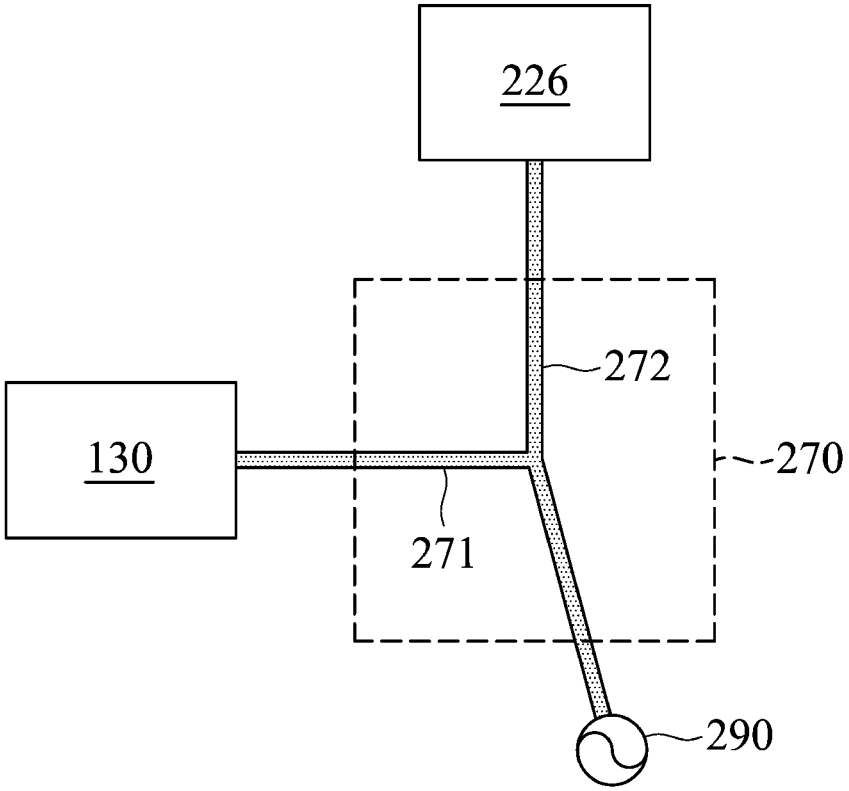
FIG. 4 is a diagram for illustrating a parallel feeding element according to an embodiment of the invention.

FIG. 4 is a diagram for illustrating the parallel feeding element 270 according to an embodiment of the invention. As shown in FIG. 4, the parallel feeding element 270 comprises two connection elements 271 and 272, wherein the connection element 271 is electrically coupled between the radiating branch 130 and the signal source 290, and the connection element 272 is electrically coupled between the ground branch 226 and the signal source 290. In an embodiment, the connection elements 271 and 272 are two metal springs or two pogo pins. In another embodiment, the connection element 271 is a metal trace, and the connection element 272 is a metal spring or a pogo pin. The parallel feeding element 270 is designed to use internal space of the mobile device 200 effectively.

Figure 5:
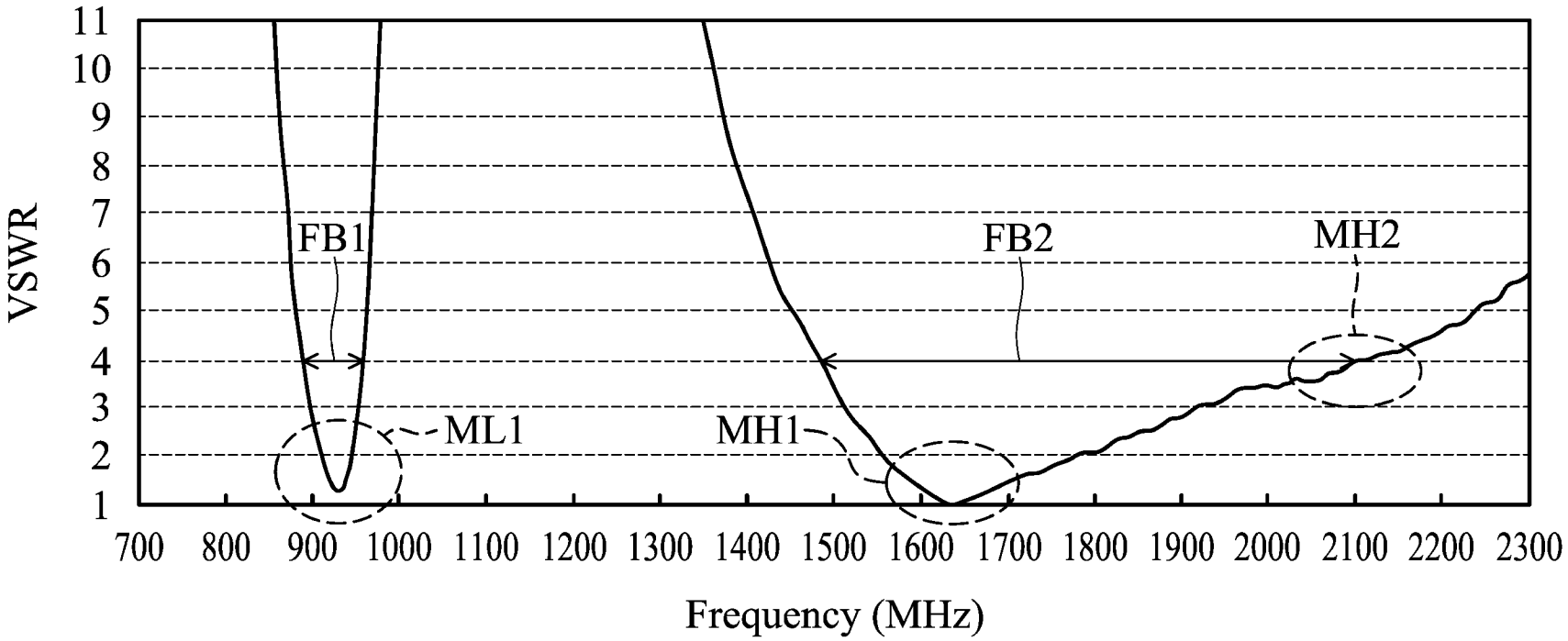
FIG. 5 is a diagram for illustrating VSWR (Voltage Standing Wave Ratio) of the mobile device according to an embodiment of the invention.

FIG. 5 is a diagram for illustrating VSWR (Voltage Standing Wave Ratio) of the mobile device according to an embodiment of the invention, wherein the vertical axis represents VSWR, and the horizontal axis represents operating frequency (unit: MHz). As shown in FIG. 5, the radiating branch 130 of the antenna structure is excited to generate a low frequency mode ML1 to form a low frequency band FB1, and the ground branch 226 (or 126) of the antenna structure is excited to generate at least two high frequency modes MH1 and MH2 to form a high frequency band FB2. More particularly, referring to FIG. 1, a first current path on the ground branch 126 (from P1 to P2 through FP to P3) is excited to generate a high frequency mode MH1, and a second current path on the ground branch 126 (from FP to P3) is excited to generate another high frequency mode MH2. Note that the point P1 is electrically coupled to the ground element 120, and the position of the point P1 is adjustable. The length of the radiating branch 130 and the length of the ground branch 226 (or 126) may be adjusted appropriately according to desired frequency bands. In a preferred embodiment, the low frequency band FB1 is approximately from 880 MHz to 960 MHz, and the high frequency band FB2 is approximately from 1428 MHz to 2710 MHz. Therefore, the mobile device of the invention can cover GSM900/Band 11/GPS/DCS1800/PCS1900/UMTS bands.

Figure 6A:
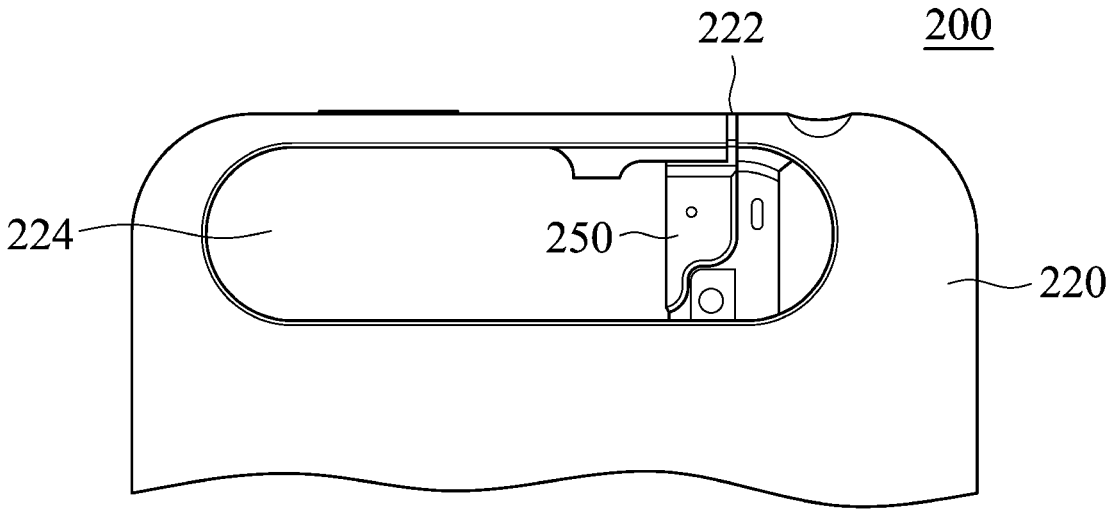
FIG. 6A is a vertical view for illustrating the mobile device according to an embodiment of the invention.

FIG. 6A is a vertical view for illustrating the mobile device 200 according to an embodiment of the invention. As shown in FIG. 6A, the ground element 220 is a conductive housing, and the slot region of the ground element 220 substantially has a straight shape. The transparent nonconductive structure 250 is partially embedded into the notch 222 of the ground element 220, wherein the notch 222 opens from the front of the mobile device 200 to the side frame/bezel and further to the back. The slot region 224 can accommodate other components, such as a camera module, a light compensation module, a loudspeaker module, or a kickstand module.

Figure 6B:
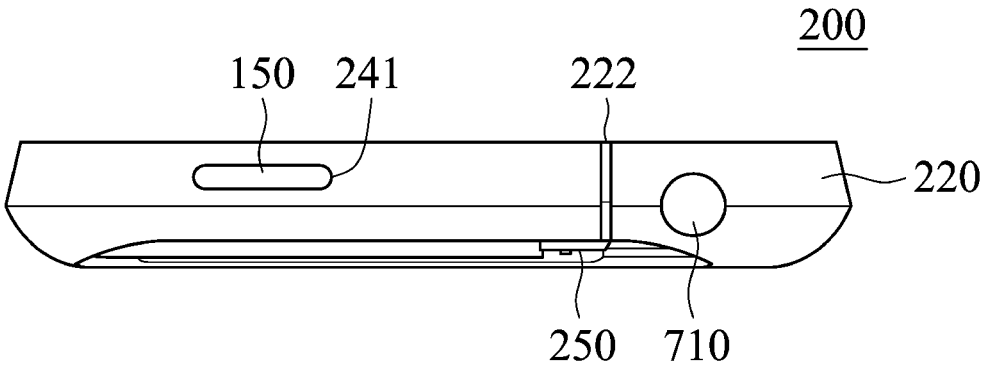
FIG. 6B is a side view for illustrating the mobile device according to an embodiment of the invention.

FIG. 6B is a side view for illustrating the mobile device 200 according to an embodiment of the invention. As shown in FIG. 6B, the power button 150 is disposed in the button hole 241 of the conductive housing. The conductive housing further has an earphone hole 710 to electrically couple earphones.

Figure 7A:
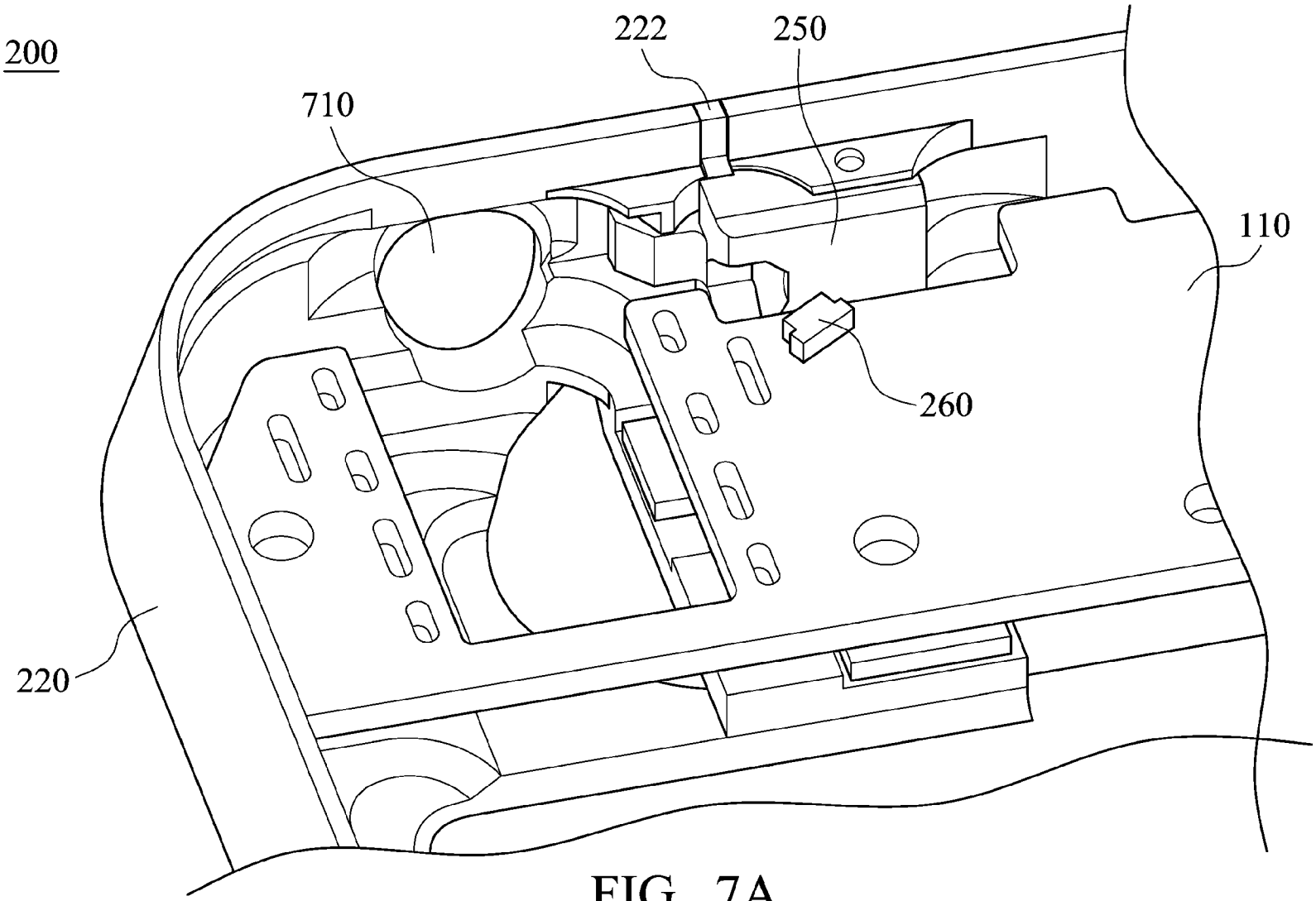
FIG. 7A is a diagram for illustrating the internal structure of the mobile device according to an embodiment of the invention.

FIG. 7A is a diagram for illustrating the internal structure of the mobile device 200 according to an embodiment of the invention. As shown in FIG. 7A, the substrate 110 may have an irregular shape. The transparent nonconductive structure 250 and the LED 260 are both connected onto the substrate 110.

Figure 7B:
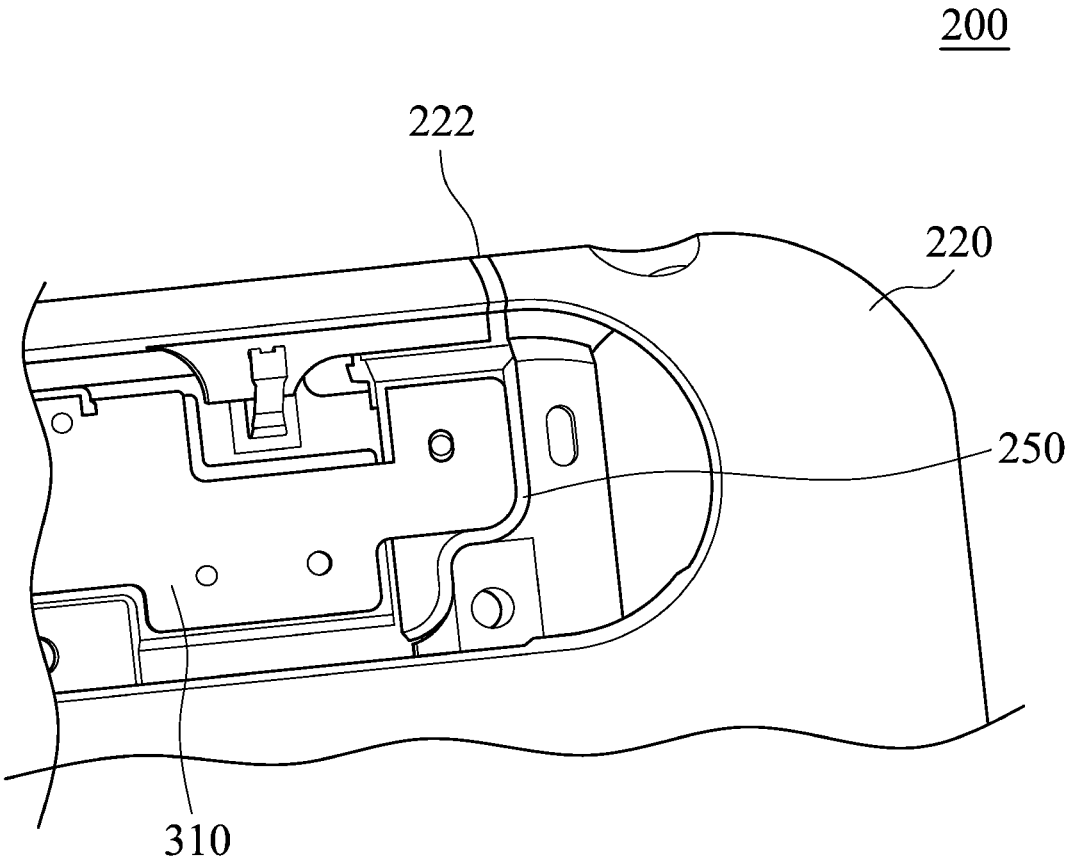
FIG. 7B is a diagram for illustrating the internal structure of the mobile device according to an embodiment of the invention.

FIG. 7B is a diagram for illustrating the internal structure of the mobile device 200 according to an embodiment of the invention. As shown in FIG. 7B, the plastic carrier 310 may have an irregular shape, and partially cover the transparent nonconductive structure 250. The plastic carrier 310 can support and fix objects thereon, such as the antenna FPCB 320 or the radiating branch 310.

Figure 7C:
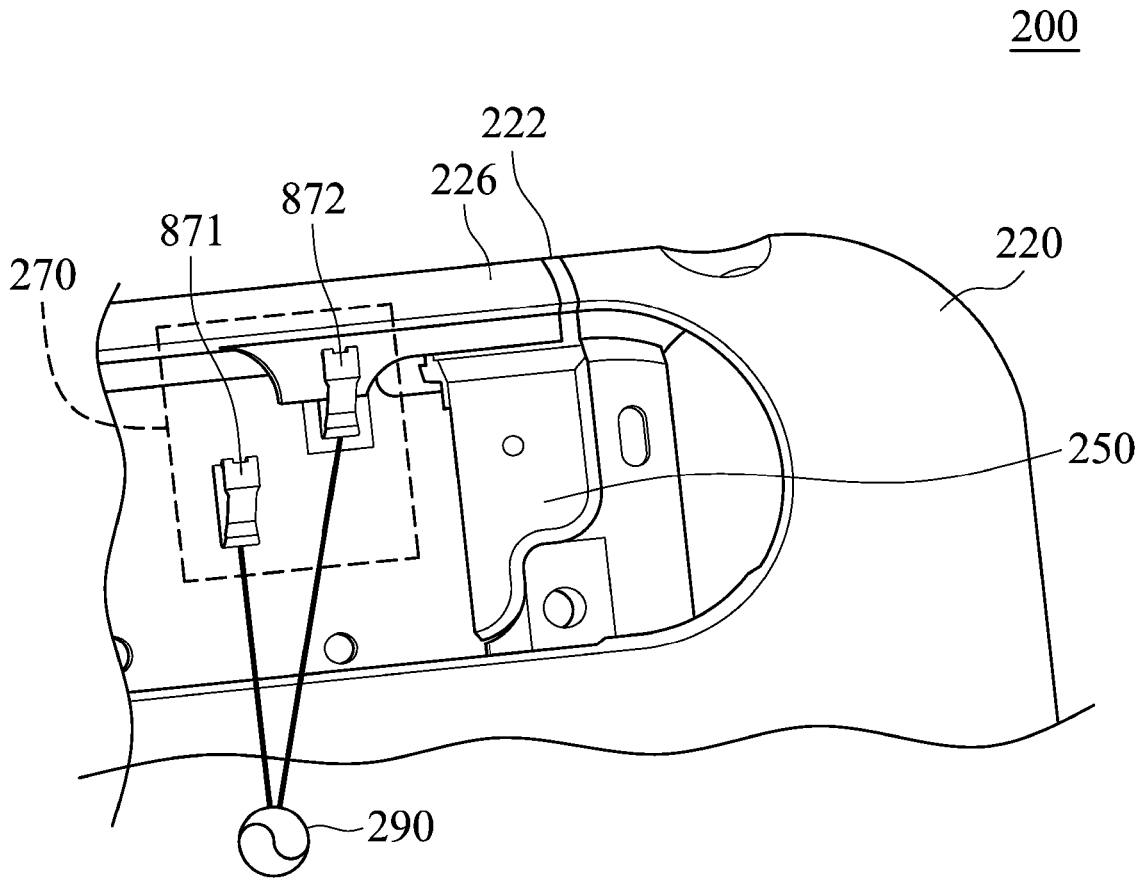
FIG. 7C is a diagram for illustrating the internal structure of the mobile device according to an embodiment of the invention.

FIG. 7C is a diagram for illustrating the internal structure of the mobile device 200 according to an embodiment of the invention. As shown in FIG. 7C, the parallel feeding element 270 may comprise two metal springs 871 and 872, wherein a signal is fed through the metal spring 871 into the radiating branch 130 (not shown), and the signal is also fed through the metal spring 872 into the ground branch 226 of the ground element 220. In the embodiment, the metal springs 871 and 872 may have different lengths.

The subject application provides a mobile device comprising an antenna structure for operation in multiple frequency bands. A power button and a signal line of the mobile device are disposed substantially along a resonant path of the antenna structure so as to avoid interference with radiation of the antenna structure. A ground element of the mobile device is implemented by a conductive housing so as to improve communication quality of the mobile device. In addition, a parallel feeding element is designed to save from taking up too much internal space in the mobile device.

The embodiments of the disclosure are considered as exemplary only, not limitations. It will be apparent to those skilled in the art that various modifications and variations can be made in the invention. The true scope of the disclosed embodiments being indicated by the following claims and their equivalents.

What is claimed is:

1. A mobile device, comprising:

a substrate;

a ground element, comprising a ground branch, wherein an edge of the ground element has a notch extending into an interior of the ground element to form a slot region, and the ground branch partially surrounds the slot region;

a radiating branch, disposed inside the slot region, and coupled to the ground branch of the ground element, wherein the ground branch and the radiating branch form an antenna structure, wherein the mobile device further comprises:

a parallel feeding element, wherein a signal source is coupled through the parallel feeding element to a feeding point on the ground branch and to a first terminal of the radiating branch, respectively, wherein the ground branch of the antenna structure is excited to form a first frequency band, and the radiating branch of the antenna structure is excited to form a second frequency band, wherein a first current path from a grounded end of the ground branch through the feeding point to an open end of the ground branch is excited to generate a part of the first frequency band, and a second current path from the feeding point to the open end of the ground branch is excited to generate another part of the first frequency band, and wherein the ground element is a conductive housing of the mobile device, and the substrate and the radiating branch are disposed in the conductive housing, and wherein the mobile device further comprises:

a transparent nonconductive structure, partially embedded into the notch of the ground element so as to separate the ground element from an open end of the ground branch; and an LED (Light Emitting Diode), disposed on the substrate, and generating light through the transparent nonconductive structure.

2. The mobile device as claimed in claim 1, wherein a length of the slot region is greater than a length of the notch.

3. The mobile device as claimed in claim 1, wherein a length of the notch is smaller than 2 mm.

4. The mobile device as claimed in claim 1, wherein the slot region substantially has a rectangular shape.

5. The mobile device as claimed in claim 1, wherein a length of the radiating branch is greater than a length of the ground branch.

6. The mobile device as claimed in claim 1, wherein the radiating branch substantially has a C-shape.

7. The mobile device as claimed in claim 1, wherein the ground branch of the ground element substantially has an L-shape.

8. The mobile device as claimed in claim 1, further comprising:

a power button, close to the ground branch;

an FPCB (Flexible Printed Circuit Board); and a signal line, disposed on the FPCB, and coupled between the power button and the substrate, wherein the signal line and the FPCB substantially extend along the ground branch.

9. The mobile device as claimed in claim 1, further comprising:

a plastic carrier, supported by the substrate; and an antenna FPCB (Flexible Printed Circuit Board), disposed on the plastic carrier, wherein the radiating branch is disposed on the antenna FPCB.

10. The mobile device as claimed in claim 1, further comprising:

a plastic carrier, supported by the substrate, wherein the radiating branch is coated on the plastic carrier.

11. The mobile device as claimed in claim 1, wherein the radiating branch is disposed on the substrate.

12. The mobile device as claimed in claim 1, wherein the low frequency band is approximately from 880 MHz to 960 MHz.

13. The mobile device as claimed in claim 1, wherein the high frequency band is approximately from 1428 MHz to 2710 MHz.

14. The mobile device as claimed in claim 1, wherein the substrate has a thickness of about 0.8 mm.

15. The mobile device as claimed in claim 1, wherein the radiating branch extends along a periphery of the slot region.

16. The mobile device as claimed in claim 1, wherein a second terminal of the ground branch functions as a ground point of the antenna structure.

17. The mobile device as claimed in claim 1, wherein the first connection element and the second connection element are two metal springs.

* * * * *